US005922477A

United States Patent [19]

Hoyt et al.

[11] Patent Number: 5,922,477

[45] Date of Patent: Jul. 13, 1999

[54] PHOTOCHEMICALLY ETCHED PLATES FOR SYNTHETIC FIBER-FORMING SPIN PACKS AND METHOD OF MAKING SAME

[75] Inventors: Matthew B. Hoyt, Arden; Charles F. Helms, Jr., Asheville, both of N.C.

[73] Assignee: BASF Corporation, Mt. Olive, N.J.

[21] Appl. No.: 08/823,539

[22] Filed: Mar. 25, 1997

[51] Int. Cl.[6] ..... B29C 47/00; B32B 7/02; B32B 3/24; B32B 15/18

[52] U.S. Cl. ..... 428/596; 428/683; 428/685; 428/686; 425/131.5; 425/190; 425/463

[58] Field of Search ..... 428/554, 560, 428/561, 544, 562, 638, 596, 685, 683, 686; 156/181; 425/131.5, 190, 463; 216/66

[56] References Cited

U.S. PATENT DOCUMENTS 5,017,116 5/1991 Carter et al. ..... 425/131.5
5,162,074 11/1992 Hills ..... 156/644
5,227,109 7/1993 Allen, III et al. ..... 264/171
5,344,297 9/1994 Hills ..... 425/131.5

*Primary Examiner*—John J. Zimmerman
*Assistant Examiner*—Darlene David

[57] ABSTRACT

Relatively thin (e.g., thickness of less than about 2.5 mm, and typically no greater than about 1.0 mm) plates for synthetic fiber-forming spin packs include a first metal layer exhibiting a relatively slow photochemical etching property and a second metal layer exhibiting a relatively fast photochemical etching property which are adhered (laminated) to one another to form a composite substrate structure. The differential etch rates as between the first and second metal layers permit relatively dimensionally larger distribution channels and relatively dimensionally precise through holes to be formed in the composite substrate. In this regard, the second metal layer permits the formation via photochemical etching of dimensionally deeper and/or wider polymer distribution channels. The first metal layer, on the other hand, allows for the formation of relatively dimensionally precise through holes via concurrent (simultaneous) etching with the second metal layer.

14 Claims, 1 Drawing Sheet

PHOTOCHEMICALLY ETCHED PLATES FOR SYNTHETIC FIBER-FORMING SPIN PACKS AND METHOD OF MAKING SAME

FIELD OF INVENTION

The present invention generally relates to the field of synthetic fibers. More particularly, the present invention relates to spin packs employed in the spinning of synthetic polymers to form fibers. In preferred forms, the present invention is embodied in photochemically etched plates forming a part of a synthetic polymer fiber-forming spin pack used to manufacture plural component (e.g., bicomponent) synthetic fibers.

BACKGROUND AND SUMMARY OF THE INVENTION

Distributor plates (or a plurality of adjacently disposed distributor plates) in a synthetic fiber spin pack in the form of thin sheets in which polymer distribution flow paths are etched (e.g., photochemically) to provide precisely formed and densely packed passage configurations are well known from U.S. Pat. Nos. 5,162,074 and 5,344,297 each issued in the name of William H. Hills (the entire content of each being expressly incorporated hereinto by reference, and hereinafter referred to as the "Hills patents"). The distribution flow paths may be shallow distribution channels arranged to conduct polymer flow along the distributor plate surface in a direction transverse to the net flow through the spin pack, and/or distribution apertures formed through the distributor plate.

In the photochemical etching process, one manner that could be envisioned in order to reduce internal spin pack pressures is to enlarge the depth of the polymer distribution channels which are photochemically etched into the plates. However, while increasing the depth of the polymer distribution channels is one possible solution to potentially excessive spin pack pressures, there is a practical limitation to the depth of such channels which is possible with current technology. In this regard, the photochemically etched holes not only penetrate into the depth of the plate, but also extend sideways (e.g., parallel to the plate surface). This leads to the through holes being larger in diameter when formed than is ideal and the resulting placement of the polymer flow to be less accurate. This is particularly critical in multicomponent spin packs where the photochemically etched plate may be used to precisely position the multiple polymer flows to create a pattern or shape to the fiber cross-section (e.g., the formation of a trilobal sheath-core bicomponent fiber where it is desirable to have a uniform thickness to the sheath polymer all around the trilobal cross-section).

Currently, therefore either high spin pack pressure drops are tolerated (with the potential for production difficulties, such as leakage) or more than one photochemically etched plate (using a thin plate for the precise holes and a relatively thicker plate (or plates) for the distribution channels is used. Use of multiple plates, however, increases the difficulties in assembling spin packs, increases inventory difficulties and/or may be more expensive. Moreover, multiple plates increase the opportunity for the plates to incorrectly align thereby leading to potentially severe processing problems.

Therefore, what has been needed in this art are improved thin photochemically etched plates usefully employed in spin packs, but which minimize (if not eliminate entirely) potentially excessive spin pack pressures. It is towards providing such improvements that the present invention is directed.

In a broad sense, the present invention is embodied in relatively thin (e.g., thickness of less than about 2.5 mm, and typically no greater than about 1.0 mm) photochemically etched plates for synthetic fiber-forming spin packs which include a metal layer exhibiting a relatively slow rate of photochemical etching properties (hereinafter "slow etch metal" or "SEM") and a layer of a metal layer exhibiting a relatively fast rate of photochemical etching properties (hereinafter "fast etch metal" or "FEM") which are adhered (laminated) to one another to form a composite substrate structure. The differential photochemical etch rates as between the SEM and FEM layers permit relatively dimensionally larger distribution channels and relatively dimensionally precise through holes to be formed in the composite substrate. In this regard, the FEM layer permits the formation via photochemical etching of dimensionally deeper and/or wider polymer distribution channels than is now possible with conventional photochemically etched spin pack plates. The SEM layer, on the other hand, allows for the formation of relatively dimensionally precise through holes via concurrent (simultaneous) photochemical etching with the FEM layer.

These and other advantages/aspects of the present invention will become more clear from the detailed description of the preferred exemplary embodiments thereof which follow.

BRIEF DESCRIPTION OF THE DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

As used herein and in the accompanying claims, the term "fiber" includes fibers of extreme or indefinite length (filaments) and fibers of short length (staple). The term "yarn" refers to a continuous strand or bundle of fibers.

The term "bicomponent fiber" is a fiber having at least two distinct cross-sectional domains respectively formed of polymers having different relative viscosities. The distinct domains may thus be formed of polymers from different polymer classes (e.g., nylon and polypropylene) or be formed of polymers from the same polymer class (e.g., nylon) but which differ in their respective relative viscosities or the presence of additives that influence flow properties. The term "bicomponent fiber" is thus intended to include concentric and eccentric sheath-core fiber structures, symmetric and asymmetric side-by-side fiber structures, island-in-sea fiber structures and pie wedge fiber structures.

The term "photochemical etch rate" is intended to refer to the amount of metal removal by a photochemical etchant per unit time period of the FEM and SEM metal layers when subjected to identical photochemical etch conditions. Preferably, according to the present invention, the FEM layer exhibits a photochemical etch rate that is at least 1.25 times, and more preferably at least about 2 times, faster than the photochemical etch rate of the SEM layer.

Figure 1:
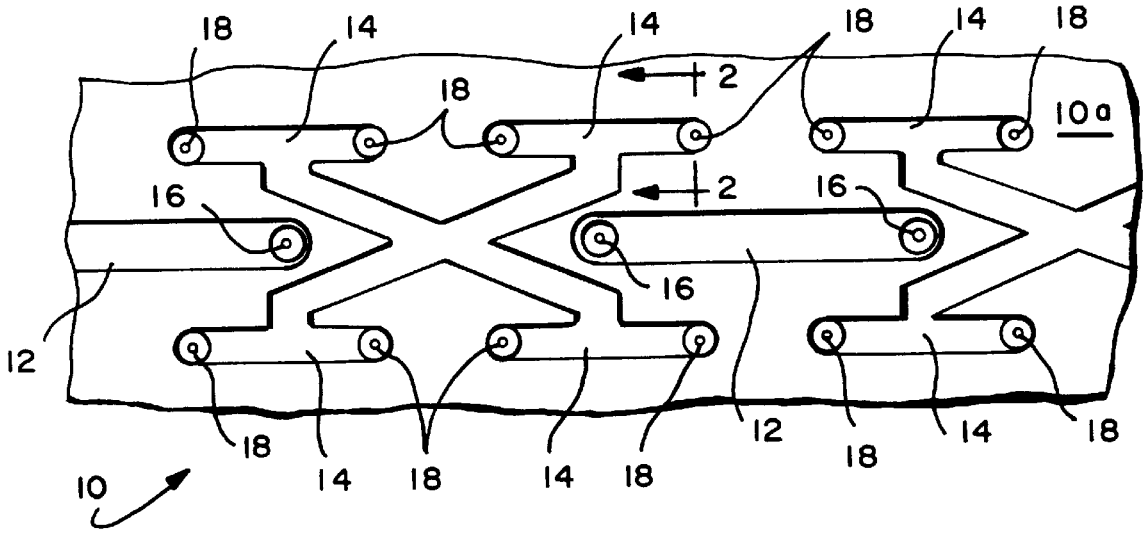
FIG. 1 is an enlarged plan view of a representative plate substrate showing one possible flow channel and through hole configuration formed therein.

Accompanying FIG. 1 depicts in plan view a representative photochemically etched plate 10 according to the present invention. In this regard, the particular flow channel and through hole layout shown in FIG. 1 is for illustrative purposes only and corresponds to one of the layouts described more completely in the Hills patents cited previously. Suffice it to say here, however, that virtually any distribution channel and through hole layout may be provided in the photochemically etched plates of this invention.

As depicted, the photochemically etched plate 10 is especially adapted for forming bicomponent fibers having two distinct polymer domains. In this regard, the etched plate 10 includes a set of polymer distribution channels noted by reference numeral 12 dedicated to one polymer component, such as the core component of a sheath-core bicomponent fiber. The photochemically etched plate 10 also includes another set of polymer distribution channels noted by reference numeral 14 dedicated to another polymer component, such as the sheath component of the sheath-core bicomponent fiber.

FIG. 1 illustrates that the core component, upon reaching the plate 10 from upstream equipment associated with the spin pack (not shown), is directed to a longitudinal straight flow channel 12 provided with through holes 16 at either end. The flow channel 12 is partially photochemically etched through the thickness of the plate 10 (i.e., is open only at the plate face 10*a*), while the through holes 16 are in fluid communication with their respective flow channel 12 so that polymer is directed by the channel 12 and into and through the holes 16. In a similar manner, the sheath component reaches the somewhat more complex slots 14 and is distributed thereby to a set of through holes 18. Upon exiting the through holes 16, 18, the respective polymer flows may then be directed by another etched plate to the spinnerette orifices of desired geometric configuration so as to form sheath-core fibers.

Figure 2:
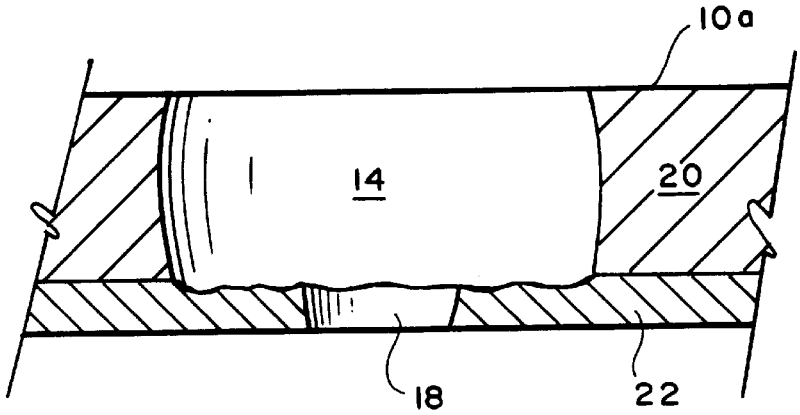
FIG. 2 is a greatly enlarged schematic cross-sectional view of the substrate depicted in FIG. 1 as taken along line 2—2 therein.

As is perhaps more clearly shown in accompanying FIG. 2, the photochemically etched plate 10 is comprised of a FEM layer 20, and a SEM layer 22 adhered to one another so as to form a composite plate-like structure. As noted previously, according to the present invention, the FEM layer is formed of a metal or metal alloy having a photochemical etch rate which is at least 1.25 times greater, and more preferably at least about 2 times greater, than the metal or metal alloy forming the SEM layer. Furthermore, the FEM layer has a thickness dimension which is at least 1.25 times greater, and more preferably at least about 2 times greater, than the thickness dimension of the SEM layer.

Although the selection of the particular metals and/or metal alloys forming the FEM and SEM layers is believed to be well within the skill of those in the art, it is presently preferred that the FEM layer be formed of spring steel, and most preferably AISI 304 (19% Cr, 10% Ni) stainless steel. On the other hand, it is presently preferred that the SEM layer be formed of a stainless steel having less than 19% Cr and less than 10% Ni, for example, X5 CrNi 18 9 stainless steel and X12 CrNi 17 7 stainless steel. One particularly preferred combination is to employ AISI 304 stainless steel as the FEM layer and to employ X12 CrNi 17 7 stainless steel as the SEM layer.

The FEM and SEM layers 20, 22 may be bonded or adhered to one another in any conventional manner. For example, the FEM and SEM layers 20, 22 may be adhered to one another using a suitable adhesive (e.g., an epoxy adhesive), soldered, CLAD or otherwise joined into an integral composite plate-like structure.

The plate 10 is formed using conventional photochemical etching techniques using photochemical etchants suitable for the metals and/or metal alloys forming the FEM and SEM layers. By way of example, when the FEM layer is formed of AISI 304 stainless steel and the SEM layer is formed of X12 CrNi 17 7 stainless steel, the preferred etchant is 2.3 molar $FeCl_3$.

The relatively deep and wide flow distribution channels will be photochemically etched into the FEM layer only of the composite plate structure, whereas through holes will be photochemically etched out from both the FEM and SEM layers of the composite plate structure with the SEM layer defining the more dimensionally precise opening. As illustrated in FIG. 2, the through holes will "neck down" (i.e., will become more precise and smaller) for the portion thereof defined by the SEM layer.

There are currently two general design criteria employed in the production of photochemically etched plates for synthetic fiber-forming spin packs. First, the outward growth of the photochemical etches are approximately one-third (⅓) of the thickness of the material being photochemically etched. Second, the minimum diameter for a through hole in a photochemically etched plate is equal to the thickness of the plate. By way of example, for a 0.6 mm thick plate, it is necessary to have a 0.2 mm mask which will "grow" 0.2 mm in all radial directions thereby resulting in a 0.6 mm diameter hole. If it is further assumed that the FEM layer is 0.8 mm thick and photochemically etches at a rate which is four (4) times faster than a 0.2 mm thick SEM layer, then the etching procedures would form a channel in the FEM layer of approximately 0.85 mm deep and approximately 1.70 mm wide. However, in such an example, the through hole in the SEM layer would only be 0.6 mm in diameter. According to conventional single layer photochemically etched plates, such an example would produce either shallow and narrow flow channels or produce an unacceptably large through hole of 1.70 mm in diameter.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A photochemically etched plate for a synthetic fiber-forming spin pack comprising a first metal layer having a first photochemical etch rate, and a second metal layer adhered to a surface of said first layer and having a second photochemical etch rate which is greater than said first photochemical etch rate of said first metal layer, wherein said second metal layer includes a channel and said first layer includes a through hole in registry with said channel and having a widthwise dimension less than a widthwise dimension of said channel.

2. A photochemically etched plate as in claim 1, wherein said first and second metal layers are stainless steel.

3. A photochemically etched plate as in claim 2, wherein the second metal layer is AISI 304 stainless steel.

4. A photochemically etched plate as in claim 3, wherein the first layer is X5 CrNi 18 9 stainless steel or X12 CrNi 17 7 stainless steel.

5. A photochemically etched plate as in claim 1, wherein the second metal layer has a photochemical etch rate that is at least about 2 times faster than the photochemical etch rate of said first metal layer.

6. A photochemically etched plate as in claim 1, wherein said second metal layer is at least about 1.25 times thicker than said first metal layer.

7. A photochemically etched plate as in claim 6, wherein the through hole has a diameter that is substantially equal to the thickness of said first metal layer.

8. A photochemically etched plate for a synthetic fiber-forming spin pack in the form of a laminated metal substrate comprised of a first metal layer having a relatively slow photochemical etch property, and a second metal layer having a relatively fast photochemical etch property, wherein said second metal layer has a photochemical etch rate that is at least about 1.25 faster than the photochemical etch rate of said first metal layer, and wherein said first metal layer includes at least one distribution channel formed therein, and said second layer includes at least one through hole in communication with said channel.

9. A photochemically etched plate as in claim 8, wherein said first and second metal layers are stainless steel.

10. A photochemically etched plate as in claim 9, wherein the second metal layer is AISI 304 stainless steel.

11. A photochemically etched plate as in claim 10, wherein the second metal layer is X5 CrNi 18 9 stainless steel or X12 CrNi 17 7 stainless steel.

12. A photochemically etched plate as in claim 8, wherein the second metal layer has a photochemical etch rate that is at least about 2 times faster than the photochemical etch rate of said first metal layer.

13. A photochemically etched plate as in claim 8, wherein said second metal layer is at least about 1.25 times thicker than said first metal layer.

14. A photochemically etched plate as in claim 13, wherein the through hole has a diameter that is substantially equal to the thickness of the first metal layer.

* * * * *